United States Patent [19]

Gill et al.

[11] Patent Number: 4,637,951

[45] Date of Patent: Jan. 20, 1987

[54] FIBROUS MAT FACER WITH IMPROVED STRIKE-THROUGH RESISTANCE

[75] Inventors: Frederick A. Gill; Mario P. Tocci, both of Littleton, Colo.

[73] Assignee: Manville Sales Corporation, Denver, Colo.

[21] Appl. No.: 685,699

[22] Filed: Dec. 24, 1984

[51] Int. Cl.[4] ..... B32B 5/24; B32B 17/10; D04H 3/12

[52] U.S. Cl. ..... 428/215; 428/216; 428/219; 428/220; 428/286; 428/290; 428/311.5; 428/316.6; 428/317.5; 428/317.7; 428/317.9; 428/337; 428/338; 428/339; 428/422; 428/448; 428/903

[58] Field of Search ..... 428/903, 286, 290, 311.5, 428/316.6, 317.5, 317.7, 317.9, 215, 216, 219, 220, 337, 338, 339

[56] References Cited

U.S. PATENT DOCUMENTS

| | | | |
|---|---|---|---|
| 4,186,236 | 1/1980 | Heitmann | 428/291 |
| 4,388,366 | 6/1983 | Rosata et al. | 428/285 |
| 4,508,775 | 4/1985 | Adiletta | 428/903 |

*Primary Examiner*—James C. Cannon

*Attorney, Agent, or Firm*—John D. Lister; Cornelius P. Quinn; Gregory A. Everitt

[57] ABSTRACT

An economical and versatile fibrous glass mat displaying improved resistance to wetting or strike-through by various curable materials when said materials are placed on one surface of said mat while in liquid state is disclosed. This mat, which is especially suited as a carrier, substrate or facer for such curable substances, comprises a blend of fibers. This blend of fibers includes a majority of base fibers having a mean diameter in the range of ten (10) microns with a minor amount of microfibers. The binder formulation, which when cured holds the blend of fibers together to form a self-supporting mat, includes conventional binder resins with a minor amount of wet proofing resinous materials.

Preferably, the resulting mat has a porosity of no greater than two-hundred and twenty-five (225) cubic feet per minute per square foot of mat in accordance with the Frazier Air Permeability Test. Also, claimed is a laminate comprising this novel mat and a vinyl plastisol coating or a coating of a foam insulation material such as a polyurethane or polyisocyanurate foam.

13 Claims, No Drawings

FIBROUS MAT FACER WITH IMPROVED STRIKE-THROUGH RESISTANCE

BACKGROUND OF THE INVENTION

The present invention relates to a novel porous fiberglass mat having particular utility as a substrate or carrier for a liquid or fluid - but subsequently hardened or cured-coating.

Fibrous non-woven fabrics, mats and papers have found particular utility where the dimensional stability, fire resistance, and flexual strength inherent in such materials are to be combined with or imparted to a continuous coating of a polymer material. These laminates have found utility as continuous sheet floor coverings and as faced polymer foam insulating boards used in roof and wall insulation in the building industry. When making such laminates, it has been found desirable to use the inherent adhesive characteristics of the curable polymer material to link a fibrous non-woven mat to the cured polymer coating. The polymer coating adheres to the mass of interlocked fibers making up the mat. This results in an integrated structure having the desired features of both the substrate i.e., the mat and the coating i.e., the polymer.

A problem involved with producing many such laminates is strike-through, that is, the inadvertent or undesired seeping through the thickness of the mat by the polymer substance while in its liquid state.

A number of solutions to this strike through phenomenon have been proposed. Most direct is to make the fibrous non-woven mat of such thickness that the time necessary for the liquid material to pass through the thick mat would exceed the time in which the liquid material would take to gel, polymerize or otherwise become non-flowing.

A second approach would be to decrease the porosity of the fibrous mat to arrest or prevent such penetration. One example of the second approach is illustrated by U.S. Pat. No. 4,186,236 wherein a pin-hole free coating of asphalt is provided to one face of a fibrous glass base mat, this coating being applied with conventional coating techniques using a thixotropic asphalt emulsion. The resulting asphalt coating presents a substantially impenetrable barrier to a liquid settable material—in this case the liquid constituents of a polyurethane foam coating.

A third general method of preventing or discouraging strike-through is to alter the surface characteristics of the fibrous structures making up the bulk of the mat in order to decrease the wettability of the fibers to the liquid coating. Such a process is illustrated in U.S. Pat. No. 4,388,366. In this patent a facing sheet comprises glass fibers bonded to each other by a bonding agent. This sheet is subsequently treated with a "non-wicking agent" thereby coating the bonded fibers with a material which prevents or discourages wicking or wetting of the fibrous mass by the liquid such as the liquid foam plastic ingredients.

Applicants have found that, while in each of the above methods a degree of strike-through prevention is achieved, substantial additional materials and/or an additional coating steps are needed to effectuate the desired benefits. The extra cost involved with the additional fibrous material or the extra process step makes the use of the glass fiber mat in particular somewhat less cost competitive with some of the other materials (papers, foils, etc,) available for these facing or substrate applications.

BRIEF SUMMARY OF THE INVENTION

Accordingly, applicants therefore have developed a remarkably versatile and cost effective porous non-woven mat for use as a facer substrate or carrier for receiving a curable substance while in a fluid state. The inventive mat comprises a blend of dispersed, substantially randomly oriented fibers and a binder for holding this blend of fibers together to form a structurally acceptable mat. The blend of fibers, according to the invention, comprises microfibers intermixed and dispersed with base fibers. The microfibers comprise between five percent (5%) and twenty percent (20%) of the total weight of the blend, and the base fibers have a mean diameter of between eight (8) microns and about twenty-five (25) microns. The binder, according to the instant invention, comprises a water miscible combination of a heat settable polymer and an effective amount of a wet proofing additive compatible with the heat settable polymer, this wet proofing additive being selected from a group consisting of a water based silicone elastomer and a fluorchemical emulsion. The resulting mat remains porous to gas penetration having a Frazier air permeability (per sq. ft. of mat) of between about 120 cubic feet per minute and about 260 cubic feet per minute, yet prevents strike-through of the curable substance while in the fluid state. The novel mat, according to the instant invention, is especially useful when forming composite materials employing a curable thermoset, preferably foamable material such as a polyurethane or polyisocyanurate rigid foam board. The same material is also useful as a carrier web in the vinyl flooring industry where the settable polymer comprises a vinyl plastisol. When utilized in these exemplary diverse composite materials systems, the mat, according to the instant invention, results in a composite having a good laminar bond strength, yet is remarkably resistant to strike-through by the diverse polymer systems applied thereon. These characteristics result in reduced downtime of the machinery involved in the coating operations. At the same time, mats in accordance with the instant invention have a cost per square foot not substantially more than conventional fiber glass mat substrates which do not provide the superior strike-through resistance or hold-out characteristics.

DETAILED DESCRIPTION OF THE INVENTION

The porous glass mat constructions according to the instant invention are generally known in the industry. Mats of this type are formed in a notorious manner known as the "wet" process. In this process, fibers, most preferably monofilament glass fibers of known surface characteristics, diameter, and of generally uniform length are dispersed in the form of a slurry, preferably a water slurry. This water slurry, in a known apparatus utilizing chemical dispersents and mechanical agitation, is subsequently filtered through a moving porous medium. The glass fibers thus become intertangled with one another in a jackstraw fashion as dewatered, thus forming a web. Subsequently this web, still on the moving screen, is treated with a conventional applicator device to a water suspension of a settable binder material. The fibers, saturated with a binder material, which conventionally comprises a urea formaldehyde polymer emulsion or a combination of urea formaldehyde polymer emulsion and an acrylic emulsion, is subsequently dewatered and dried under with heated air to form a strong, self supporting mat. Details of this process and an example of such a mat are contained in U.S. Pat. No. 4,129,674 which patent is hereby incorporated by reference.

In contrast with conventional glass mats, however, the present mat comprises a fibrous mass of two (2) types glass of fibers, both being glass monofilament fibers. The first type, hereinafter referred to as base fibers, comprise glass monofilament fibers of conventional form and composition. Generally, these fibers are made by a continuous filament process and chopped to discreet and predetermined lengths for convenience in handling and easy dispersiblity in the wet forming process. Typically such fibers are between one quarter inch and one inch in length and have a diameter which is determined primarily by the convenience of producing these fibers in the continuous filament manner. Typically, these fibers are between eight (8) microns and twenty-five (25) microns in diameter. The lower diameter limit is set by process restraints. The upper limit is determined by material usage considerations as well as the hand or feel of the final mat material. The coarser fibers result in an abrasive and irritating feel which would make such a mat less desirable.

The other basic type of fiber in the mat is microfibers. Microfiber is a term of art referring to fibrous materials having a mean diameter in the neighborhood of one (1) micron. These fibers are preferably flame attenuated glass fibers although other compositions could be used depending on the relative costs of such microfibers, their ability to disperse evenly in the water slurry of the wet process apparatus, and their ability to modify the permeability of the resulitng fibrous mat to the extent in the manner as will be set forth in detail. More particularly the microfibers are of the type and are formed in the manner as set forth in U.S. Pat. No. 4,167,404, which patent is hereby incorporated by reference. For the purposes of this invention, however, microfibers are defined as fibers having mean diameters ranging from 0.05–3.50 microns, more typically 0.1 to 0.7 microns. These fibers are formed in a flame-attenuating process as set forth in the above referenced and incorporated patent. After being collected, the microfibers, as a mat of staple fibers, are chopped, milled or otherwise reduced in length to form a mass of microfiber monofilaments for subsequent addition to the mat forming water dispersion. The resulting average length of the microfibers can be controlled to some degree. Preferably this average length should be in one order of magnitude of the length of the base fibers used in making the mat in accordance with the instant invention. However, while the base fiber may be in the range of $\frac{1}{4}$–$1\frac{1}{4}''$, typically $\frac{1}{2}$–$\frac{3}{4}''$ and preferably one-half inch ($\frac{1}{2}''$), the microfiber lengths may range in average between one-quarter ($\frac{1}{4}''$) and one-eighth inch ($\frac{1}{8}''$) as will be set forth in more detail below.

To form the web from these two diverse types of preferably glass monofilament fibers, ordinary dispersing techniques may be formed and microfibers are added in an amount which would result in a predetermined weight percent of the resulting fibrous web being composed of the microfibers relatively uniformly dispersed on, between and among the base fibers. It has been found that the microfibers can best be dispersed by mechanically feeding a predetermined volume of the dry microfiber mass into the hydropulper, then subsequently metering this pulped microfiber slurry into the primary water chest. Alternatively, a microfiber slurry containing one-percent (1%) concentration of microfiber can be metered into the white water slurry itself.

The second major aspect of the instant invention, namely the binder formulation having characteristics as will be set forth in detail, is also critical in the proper operation of the inventive fiber mat as a facer or substrate material.

The binder can take many forms but most characteristically the binder includes a primary binder ingredient, usually a urea formaldehyde resin water based emulsion or a blend of the UF resin with some other water based polymer emulsions, such as a acetate or acrylic emulsion.

The second major constituent of the binder is a hold-out additive. A number of particular commercially available materials have been determined to be especially useful. However, the scope of the instant invention should not be limited by these particular examples. Other materials, meeting certain basic requirements as will be set forth, can be used and thus fall within the scope of the instant invention.

As a first requirement, this hold-out additive should be available or reducible to a water based emulsion or otherwise made compatible with the basic binder resin in the conventional method of applying the binder in the form of a water suspension as set forth above.

Secondly, the hold-out additive should be one which does not prereact with the basic binder resin. That is, one which does not gel, solidify or take out of suspension the basic binder resin while in the emulsified form. These two criteria can readily be determined by empirical means.

Finally, the hold-out additive/resin binder combination (when used at conventional binder weight percentages) must be effective to prevent wetting and penetration of the porous mat by the settable fluid substance for a predetermined period of time. This time should correspond to a worse case dwell time of the curable material in its liquid state that the treated mat would experience in a normal production operation of the laminate of which the mat will be a part. Unless otherwise stated, this dwell time is five minutes although it is understood that other times and other liquid curable substances could be substituted.

Two particular families of hold-out additives have been identified. The first takes the form of a fluorochemical compound such as those available to the paper industry in the form of a water dispersible fluorochemical copolymer emulsion which is designed to impart water, oil, solvent and low surface tension fluid hold-out characteristics to paper, paperboard mineral coatings and non-woven substrates. Such a material is available from Minnesota Mining & Manufacturing Company as a product designated as FC 808 "Scotchban" brand paper protector.

Another family of wet proofing resins would be that family of water based silicone elastomer emulsions. An example of these materials is represented by Dow Corning Q3-5024 silicone water based elastomer available from Dow Corning USA, 18008 Skypark Blvd., Suite 145, Irvine, Calif. 92714.

In both cases the hold-out function of these materials is triggered or initiated upon drying or driving off of the water. These materials, when combined with the conventional binder resins, impart the wet proofing to the cured binder/mat system, even when used in relatively small amounts, i.e., diluted by the greater proportion of mat binder resins in the binder formulation.

When used as taught by the following examples, it has been found that the combination of microfibers and the novel binder formulation results in a non-woven glass mat which is economical to manufacture due to the synergistic effect of the relatively small amounts of relatively expensive microfibers in combination with the relatively small amounts of the relatively expensive hold-out ingredient.

A standard measure of porosity used in glass mat materials is the Frazier Air Permeability Test. In this test a sample of fabric is suspended in a chamber through which is passed air at 70° F. and 65% relative humidity and thirty (30) inches of atmospheric pressure. Air velocity and volume are controlled so that the manometer on the high pressure side of the mat being tested is a five (5) inch reading (using a Miriam red oil manometer fluid with a specific gravity of 0.827). The resulting reading on the test gives the cubic feet per minute of air which can pass through each square foot of the mat. This test not only determines the relative air permeabilities of porous mats, but it can also be used as a criterion for distinguishing between an effective amount of microfiber when combined with base fiber for use in the instant invention.

EXAMPLE 1

To a standard resin binder formula comprising fifty percent (50%) urea formaldehyde resin (such as Georgia-Pacific No. 2967) and fifty percent (50%) polyvinyl acetate emulsion, (such as Duracet No. 12) is added two-tenths percent (0.2%) on a dry weight basis of the fluorochemical copolymer or the silicone emulsion as described above. A sample of the glass fiber mat (unbonded) to be treated with this binder material is saturated with the material, the excess liquid emulsion is removed and the binder emulsion/treated mat is dried using an infrared heater or convective hot air for a minimum of two minutes to a temperature of 300° F. The fiber glass mat was subjected to various fluid materials, including water, a high index polyol constituent of a polyisocyanurate and foam, a low index polyol of a polyisocyanurate foam composition. It was found that while the water and the low index polyol did not penetrate the formed glass mat, the high index polyol had penetrated into and had wetted through the mat in a short time.

EXAMPLE 2

The binder formula as set forth in Example 1 was applied to a glass fiber mat comprising seven and a half percent plus or minus two and one-half percent ($7\frac{1}{2}\% \pm 2\frac{1}{2}\%$) dry weight of flame attenuated glass microfibers having an average diameter of 0.54 to 0.68 microns as described above. The finished mat weighed 6.15 grams/sq.ft. with the total binder comprised of a dry weight or 29% of the total weight of the mat. Air permeability as defined above was 180 cubic feet/min. Total mat thickness amounted to about 16 mils. Upon being subjected to the water, high index polyol and low index polyol, this mat resisted wetting or penetration of the test fluids for several minutes until the experiment was terminated.

EXAMPLE 3

A binder formulation identical to that described in Examples 1 and 2 was used to form a glass fiber mat comprising base fibers as set forth above and 22 percent of microfibers having an average diameter of approximately 2.5–4.0 microns. This mat weighed 6.2 grams/ft$^2$ of which 37% was binder. Air permiability was 220 cubic ft./sec. Upon being subjected to the test fluids as set forth in Examples 1 and 2, it was found that the penetration of the fluids was better than that in Example 1 and was adequate as a facer for the production of polyurethane foam board.

By the above process it was determined that the minimum practical amount of microfibers which would impart to the glass mat a controlled degree of porosity necessary ranged from about 2% to about 37% depending primarily on fiber diameter. No operable upper limit to microfiber content was determined. However, greater microfiber percent results in a greater density and lower porosity material. An upper practical limit, based on the incremental cost of the microfibers used has been determined to be from between 10 and 40% total weight of the mat. Above this percentage the cost of the microfibers to the overall cost of the product exceeds the incremental cost of the post-treating or post-coating process as outlined with reference to the asphalt coated facing product as set forth above. Below the minimum percentages of microfibers, the amount of wet proofing resins needed to prevent penetration becomes prohibitively high. At such levels a post-treatment or coating using these materials is necessary and/or an inordinately large percentage of the binder formula must be taken up by these materials, thus increasing costs prohibitively and potentially weakening the mechanical strength of the resulting mat.

I claim

1. A porous, non-woven fabric mat for use as a facer, substrate, or carrier for receiving a curable substance while in the fluid state, said mat comprising a blend of dispersed, substantially randomly oriented fibers and a binder for holding said blend of fibers together;

said blend of fibers comprising microfibers intermixed with base fibers said microfibers comprising between two percent (2%) and about forty percent (40%) of the total weight of said blend, said base fibers having a mean diameter of between about eight (8) microns and about twenty-five (25) microns;

said binder comprising a water miscible combination of a heat settable binder resin and an effective amount of a wet proofing polymer resin compatible with said heat settable binder resin, said wet proofing polymer being selected from a group consisting of a water based silicone elastomer and a fluorchemical emulsion.

2. A porous non-woven fabric mat for use as a facer, substrate or carrier for receiving a curable substance while in the fluid state, said mat comprising of a blend dispersed substantially randomly oriented fibers and a binder for holding said blend of fibers together;

said blend of fibers comprising a minor amount of microfibers intermixed with said base fibers, said base fibers having a mean diameter of between eight (8) microns and about twenty-five (25) microns, said binder comprising a water miscible combination of a heat settable binder resin and an effective amount of a wet proofing polymer compatible with said heat settable resin, said wet proofing polymer selected from a group consisting of a water based silicone elastomer emulsion and a fluorchemical emulsion, said mat being permeable to air but having a Frazier Air Permeability of not more than about two hundred and twenty-five (225) cubic feet per minute, the mat having a thickness of between about ten (10) mils and about sixty (60) mil.

3. A mat as set forth in claim 1 having a Frazier Air Permeability of between about forty (40) cubic feet per minute and about two hundred and twenty-five (225) cubic feet per minute.

4. A mat as set forth in either claim 1 or claim 2 having a total weight of between six (6) grams per square foot and about ten (10) grams per square foot.

5. A laminate comprising a coating of a curable substance adhered to at least one surface of a mat, said mat comprising a blend of dispersed, substantially randomly oriented fibers and a binder for holding said blend of fibers together;

said blend of fibers comprising microfibers intermixed with base fibers said microfibers comprising between two percent (2%) and about forty percent (40%) of the total weight of said blend, said base fibers having a mean diameter of between about eight (8) microns and about twenty-five (25) microns;

said binder comprising a water miscible combination of a heat settable binder resin and an effective amount of a wet proofing polymer resin compatible with said heat settable binder resin, said wet proofing polymer being selected from a group consisting of a water based silicone elastomer and a fluorochemical emulsion.

6. A laminate as set forth in claim 5 wherein said curable substance comprises a vinyl plastisol.

7. A laminate as set forth in claim 5 wherein said curable coating is a foam insulation selected from a group consisting of a polyurethane, a polyisocyanurate, phenolic, and polystyrene.

8. A mat as set forth in any of claims 1 and 2 wherein said base fibers are glass monofilament fibers having an average length of between one-eighth ($\frac{1}{8}$) inch and one-half ($\frac{1}{2}$) inch and an average diameter of between about eight (8) microns and about eleven (11) microns.

9. A mat as set forth in either claim 1 or claim 2 wherein said microfibers are monafilament glass fibers having a mean length of between one-eighth ($\frac{1}{8}$) and one-quarter ($\frac{1}{4}$) inch and an average diameter of between about 0.025 microns and six (6) microns.

10. A laminate comprising a coating of a curable substance adhered to at least one surface of a mat, said mat comprising a blend of dispersed substantially randomly oriented fibers and a binder for holding said blend of fibers together;

said blend of fibers comprising a minor amount of microfibers intermixed with base fibers, said base fibers having a mean diameter of between eight (8) microns and about twenty-five (25) microns, said binder comprising a water miscible combination of a heat settable binder resin and an effective amount of a wet proofing polymer compatible with said heat settable resin, said wet proofing polymer selected from a group consisting of a water based silicone elastomer emulsion and a fluorochemical emulsion, said mat being permeable to air but having a Frazier Air Permeability of no more than about two hundred and twenty-five (225) cubic feet per minute, the mat having a thickness of between about ten (10) mils and about sixty (60) mil.

11. A laminate as set forth in claim 10 wherein said curable substance comprises a vinyl plastisol.

12. A laminate comprising a coating of a curable substance adhered to at least one surface of a mat, said mat comprising:

a blend of dispersed substantially randomly oriented fibers and a binder for holding said blend of fibers together;

said blend of fibers comprising a minor amount of microfibers intermixed with said base fibers, said base fibers having a mean diameter of between eight (8) microns and about twenty-five (25) microns, said binder comprising a water miscible combination of a heat settable binder resin and an effective amount of a wet proofing polymer compatible with said heat settable resin, said wet proofing polymer selected from a group consiting of a water based silicone elastomer emulsion and a fluorochemical emulsion, said mat being permeable to air but having a Frazier Air Permeability of between about forty (40) and about two hundred and twenty-five (225) cubic feet per minute, the mat having a thickness of between about ten (10) mils and about sixty (60) mils.

13. A laminate as set forth in claim 12 wherein said curable substance comprises a vinyl plastisol.

* * * * *